United States Patent [19]

Ottos

[11] 4,445,872

[45] May 1, 1984

[54] METHOD OF DETECTING THE VAPORIZATION OF GETTER MATERIAL DURING MANUFACTURE OF A CRT

[75] Inventor: James G. Ottos, Lancaster, Pa.

[73] Assignee: RCA Corporation, New York, N.Y.

[21] Appl. No.: 340,526

[22] Filed: Jan. 18, 1982

[51] Int. Cl.[3] ..... H01J 9/42

[52] U.S. Cl. ..... 445/3; 324/404

[58] Field of Search ..... 445/3, 4, 9; 324/404

[56] References Cited

U.S. PATENT DOCUMENTS

| | | | |
|---|---|---|---|
| 3,153,190 | 10/1964 | Spalding | 445/3 X |
| 3,292,988 | 12/1966 | Kimball | 445/3 |
| 3,508,105 | 4/1970 | Pappadis | 313/178 |
| 3,558,961 | 10/1971 | Palsha | 313/174 |
| 3,558,962 | 1/1971 | Reash | 313/180 |
| 4,302,063 | 11/1981 | Rudy | 316/25 |

*Primary Examiner*—Kenneth J. Ramsey

*Attorney, Agent, or Firm*—E. M. Whitacre; D. H. Irlbeck; L. Greenspan

[57] ABSTRACT

In a method of vaporizing getter material from a getter container inside a vacuum electron tube, light from the vaporization is sensed at least from the outset of the heating of the container. A time-dependent sample signal is produced from the sensed light which is compared with time-dependent criteria related to the vaporization, and a characteristic of the vaporization is derived from the comparison.

10 Claims, 5 Drawing Figures

METHOD OF DETECTING THE VAPORIZATION OF GETTER MATERIAL DURING MANUFACTURE OF A CRT

BACKGROUND OF THE INVENTION

This invention relates to a novel method of detecting the vaporization of getter material during the manufacture of a CRT (cathode ray tube). In addition to detecting the vaporization of getter material, the method can be used to determine whether the vaporization is predominantly exothermic or endothermic, whether more than a prescribed quantity of getter material has vaporized, and whether a substantial amount of ionization has occurred during the vaporization.

In one popular design of a color television picture tube, which is a type of CRT, a getter container having getter material therein is held against, or close to, the inner surface of the envelope, usually that part of the envelope called the funnel. After the envelope is evacuated of gases and sealed, an induction coil is positioned against, or close to, the outer surface of the envelope opposite the getter container and is then energized with high-frequency current. The magnetic field generated by the energized coil induces currents in the getter container, causing the temperature of the getter container and the getter material therein to rise rapidly to temperatures above about 800° C. until the getter material, which is usually barium metal, vaporizes and deposits as a getter film on the internal surfaces of the tube. A purpose of the getter film is to absorb both residual gas left in the envelope after evacuation and to adsorb gas that is later evolved from internal surfaces during the operating life of the CRT. The life of the CRT is determined principally by the ability of the getter film to continue to absorb gas and to maintain a low gas pressure in the envelope. Thus, it is desirable to deposit an optimum distribution of the greatest amount of getter material in the CRT.

With the demand for higher quality and lower manufacturing costs, it is important to know, during or soon after the induction coil is energized, whether vaporization has taken place. Also, it is desirable to know some of the qualities of the vaporization, such as whether the vaporization is predominantly exothermic or endothermic, whether more than a prescribed quantity of getter material has vaporized, and whether a substantial amount of ionization has occurred during the vaporization. Prompt knowledge of one or more of these factors permits prompt adjustment of the equipment, particularly automated equipment, and permits tubes which have not been processed properly to be identified and removed for reprocessing.

At present, two methods are used to determine whether vaporization has taken place. One method takes advantage of the light that is emitted by the container and getter material during the heating step. An operator observes the change in the brightness of light emanating from inside the CRT during the energization of the coil. This method is only qualitative and may be obscured by structures, such as metal shields, in the CRT. In the other method, the operator observes whether metal is deposited on a clear area of glass of the CRT envelope. That clear area must be in the path of the vaporized material and the path must not be obstructed by structures, such as metal shields inside the CRT. By either method, the operator must take time to observe the event, and then can determine only whether vaporization has taken place if all of the above-mentioned conditions are satisfied.

SUMMARY OF THE INVENTION

The novel method, as in prior methods of vaporizing getter material, includes heating the getter material in a container inside a CRT until getter material vaporizes and whereby light is emitted from the container and the getter material. In the novel method, unlike prior methods, the brightness of the emitted light is sensed, not by an operator, but by an electronic photodetector from at least the onset of the heating of the container, and an electronic time-dependent sample signal of the sensed light is produced. The sample signal is compared with time-dependent criteria derived from vaporizations with known characteristics, and, from the comparison, characteristics of the sample vaporization are derived.

DESCRIPTION OF THE PREFERRED EMBODIMENT

Getters and their use in electron tubes are well known. Getters and their use in cathode-ray tubes in particular need not be described in detail here since they have been described previously; for example, in U.S. Pat. Nos. 3,508,105 issued Apr. 21, 1970 to N. P. Pappadis, 3,558,962 issued Jan. 26, 1971 to C. W. Reash, 3,964,812 issued June 22, 1976 to J. C. Turnbull and 4,302,063 issued Nov. 24, 1981 to W. G. Rudy.

Figure 1:
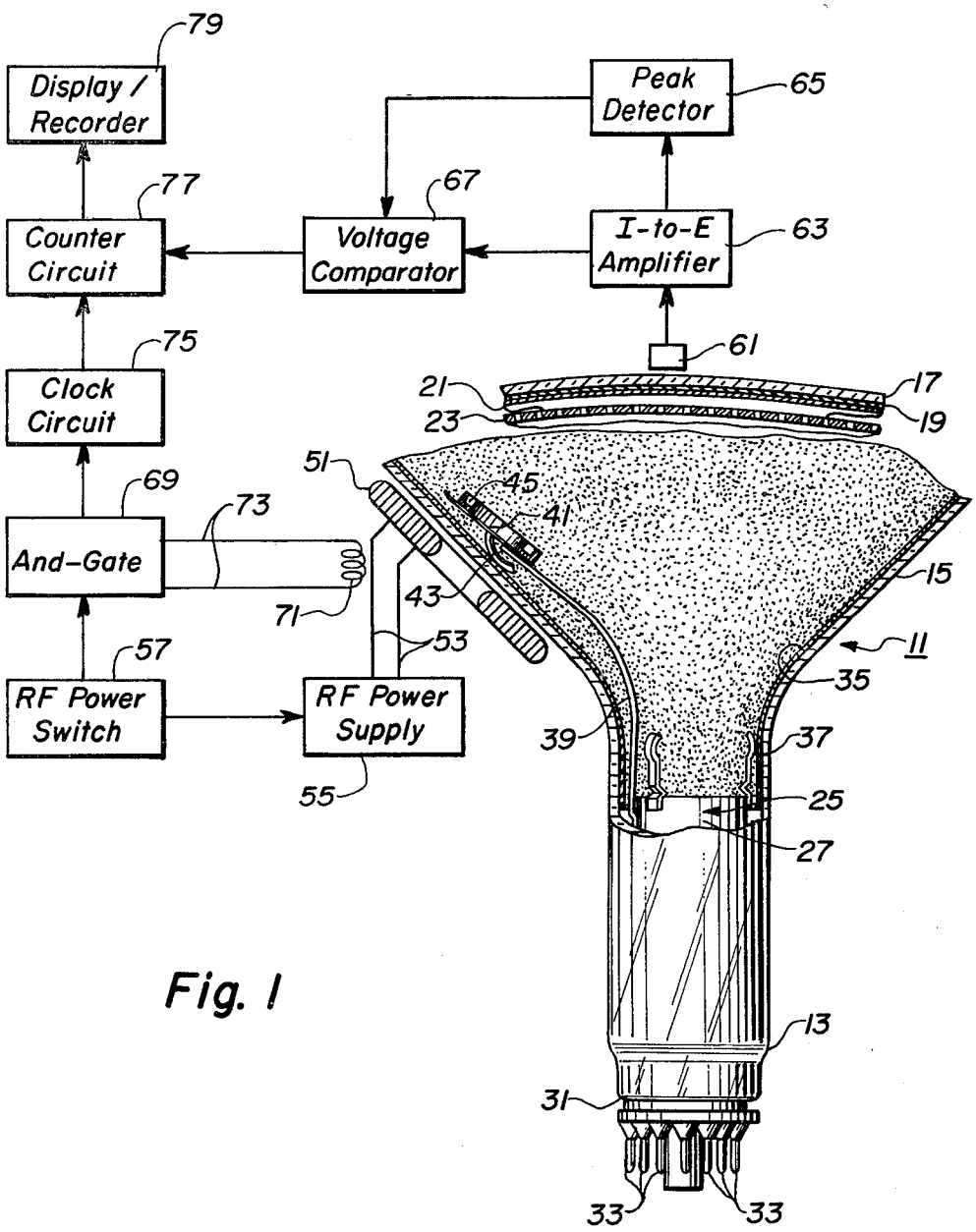
FIG. 1 is a fragmentary view, partially in cross section, of a CRT having the getter container in position for induction heating prior to vaporizing the getter material therein, and a block-diagram circuit for detecting vaporization by the novel method.

FIG. 1 shows as much of a color television picture tube, which is a type of CRT, as is necessary for understanding the novel method. The CRT comprises an evacuated envelope 11 including a cylindrical neck 13 extending from the small end of a funnel 15. The large end of the funnel 15 is closed by a faceplate panel 17. A tricolor mosaic luminescent screen 19, which is backed by a reflecting metal layer 21 of aluminum metal, is supported on the inner surface of the panel 17. The screen 19 comprises a multiplicity of trios, each comprising a green-emitting, a red-emitting and a blue-emitting element. A shadow mask 23 is supported within the envelope close to the screen 19 to achieve color selection. The mask 23 is a metal sheet having an array of apertures therein, which apertures are systematically related to the trios of the screen 19. An electron-gun mount assembly 25 located within the neck 13 comprises an array of three similar electron guns. The mount assembly 25 includes a shield cup 27 which is that element of the mount assembly closest to the screen 19. The end of the neck 13 is closed by a stem 31 having terminal pins or leads 33 on which the mount assembly 25 is supported and through which electrical connections are made to various elements of the mount assembly 25. An opaque, electrically-conducting funnel coating 35 comprising graphite, iron oxide and a silicate binder on the inner surface of the funnel 15 is electrically connected to the high-voltage terminal or anode button (not shown) in the funnel 15. Three bulb spacers are welded to and connect the shield cup 27 with the funnel coating 35. The bulb spacers 37, which are preferably made of spring steel, also center and position the extended end of the mount assembly 25 with the longitudinal axis of the tube.

A getter assembly comprises an elongated spring 39 which is attached to one end of the shield cup 27 and extends in cantilever fashion into the funnel 15. A metal getter container 41 is attached to the other extended end of the spring 39, and a sled including two curved runners 43 is attached to the bottom of the container 41. The container 41 has a ring-shaped channel containing getter material 45 with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be positioned well within the funnel 15, where the getter material can be flashed (vaporized) to provide optimun distribution and where the spring 39 and the container 41 will be out of the paths of the electron beams issuing from the mount assembly 25 during the operation of the tube.

As shown in FIG. 1, the tube is assembled and the envelope has been evacuated of gases and hermetically sealed. This may be achieved by any of the known fabrication and assembly procedures. However, the getter material has not been vaporized from the getter container 41. In this embodiment, the getter container holds a mixture of nickel metal and a barium-aluminum alloy, which upon heating above about 800° C. reacts exothermically, vaporizing barium metal and leaving a residue of an aluminum-nickel alloy in the container 41.

To flash the getter; that is, to cause the exothermic reaction to take place, use is made of an induction heating coil 51 which is positioned outside the tube with respect to the container 41. The induction coil 51 is connected through leads 53 to an RF power supply 55 which may be activated either manually or automatically by an RF power switch 57 connected thereto. Magnetic fields from the energized induction coil 51 will heat the getter container and its contents 45 rapidly until the contents react, releasing barium metal vapor, which deposits principally on the mask 23 and portions of the opaque coating 35 opposite the getter container 41.

One suitable RF power supply is induction heating generator T -2.5-1-KC11-B3W marketed by Lepel Corporation, Maspeth, N.Y. 11378. This generator is designed to deliver to the induction heating coil 51 about 2.5 kw of high-frequency energy in the range of 250 to 800 KHz. This generator includes a high-voltage DC power supply, a modified Hartly oscillator, a tapped tank coil and a control system. The control system is designed for either manual operation or automatic operation. The output signal from the switch 57 may be used directly or through a relay for automatic operation of the RF power supply 55.

Also shown in FIG. 1, is an infrared photodetector assembly 61 positioned outside the CRT 11, closely spaced from the faceplate panels 17. The photodetector assembly 61 includes a filter which passes wavelengths longer than about 7,000 angstroms, a detector which is sensitive to wavelengths from about 3,500 angstroms up to about 11,000 angstroms, and a shield to block out ambient light. One suitable combination is an Ealing infrared filter catalog No. 26-4499 (Ealing Corporation) and a PIN 10D diode silicon photodetector (United Detector Corp.). The photodetector assembly 61 may be moved as a unit to any position on the panel 17. Each tube type has an empirically-determined optimum position which is generally off the longitudinal axis of the CRT.

The output signal of the photodetector is photocurrent measured in nanoamperes ($10^{-9}$ amperes), which is fed to an I-to-E (current-to-voltage) amplifier 63 to convert and amplify the output signal to a sample voltage signal which is believed to be easier to process. The sample voltage signal is passed to a peak detector 65 and a voltage comparator 67.

One feature of interest in the sample voltage signal is the time-to-peak; that is, the time interval between when the coil 51 is energized and when the peak in the signal occurs. To determine when the coil 51 is energized, there is provided an and-gate 69 which will pass an output signal when both the RF power switch 57 is activated and when current flows in the leads 53 to the coil 51. Current flow to the coil 51 is sensed by an electromagnetic sensor 71 adjacent one of the coil leads 53, which induces a current in the sensor 71 that is fed to the and-gate 69 by the leads 73.

The output signal of the and-gate 69 is fed to a clock circuit 75 to start a clock circuit 75 running. The outputs of both the clock circuit 75 and the voltage comparator 67 are fed to a counter circuit 77 which correlates the two signals to yield a time-dependent sample voltage signal which may be displayed and/or recorded on a display-recorder 79. Also, the sample signal may be fed to a device and/or circuit (not shown) which activates an alarm, or to a processing mechanism, such as a device for marking the processed CRT.

Figure 2:
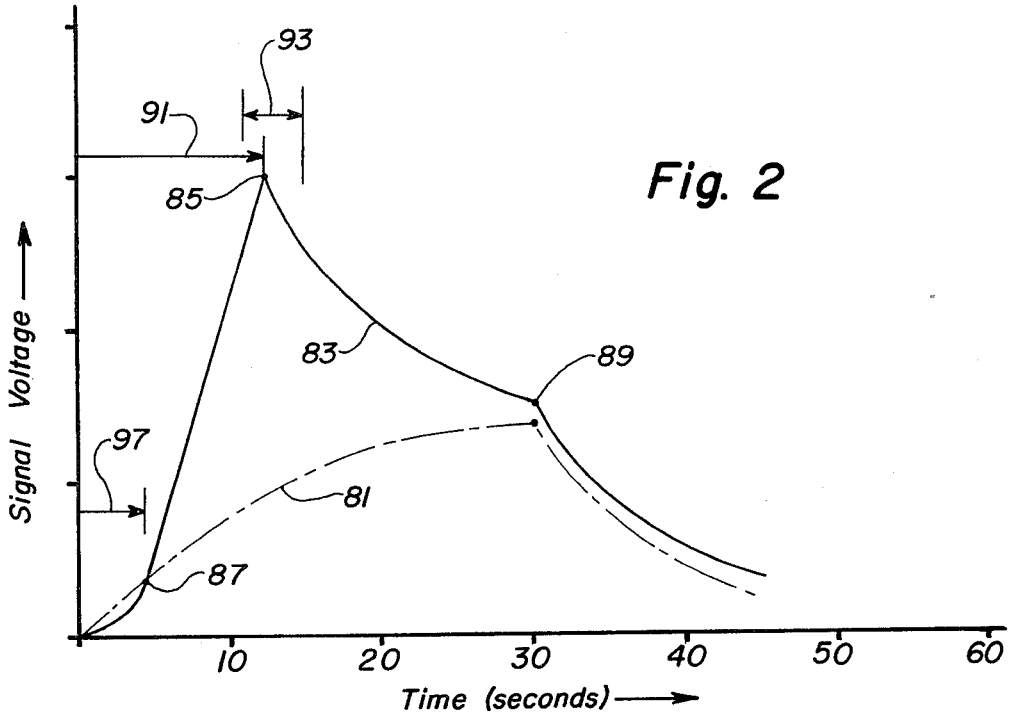
FIG. 2 is a diagram showing several typical time-dependent sample signal curves evidencing vaporization during the practice of the novel method.

FIG. 2 shows a family of typical (but idealized) curves of the time-dependent sample signal which may be recorded on the display-recorder 79 of FIG. 1. Three different situations are possible.

If no getter container is present opposite the RF coil 51, no curve is generated. This may occur, for example, if the coil 51 is on the wrong side of the CRT, or if the getter container was not installed in the CRT.

If the vaporization from the getter container 41 is endothermic, then a slowly-rising rounded curve 81 is generated. This occurs, for example, when the getter container 41 has been subjected to a previous vaporization, or when the getter material 45 in the container 41 fails to react exothermically.

If the vaporization from the container 41 is exothermic, then a rapidly-rising curve 83 with a sharp peak 85 is generated. In addition to the peak 85, this curve 83 shows a first break 87 at the start of the flash; that is, the start of the exothermic reaction. Prior to this break, the container 41 is merely being heated up by magnetic induction from the coil 51. There is also a second break 89 when the RF energy to the coil 51 is turned off. After this point, the container cools by radiation.

Figure 3:
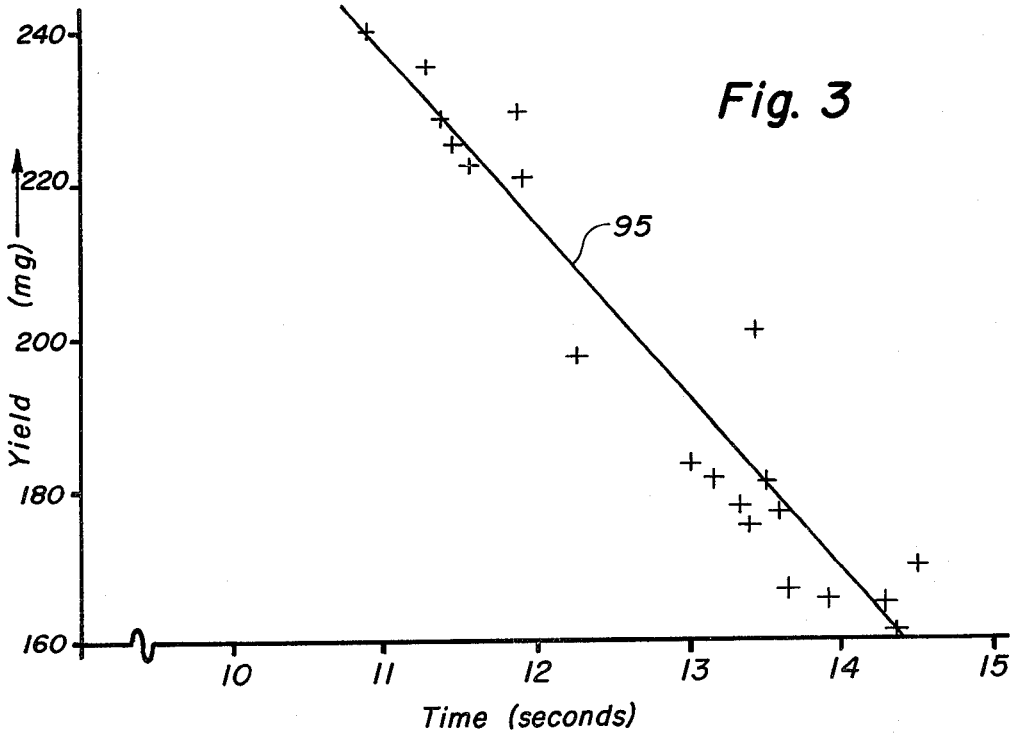
FIG. 3 is a diagram plotting the yield of vaporized barium vs. the time-to-peak for a plurality of vaporizations according to the novel method.

The time-to-peak, shown by the first arrow 91 in FIG. 2, is significant in that the relative yields of vaporized getter material can be derived therefrom. Generally, the longer the time-to-peak 91, the lower the yield within a limited range of about 10 to 15 seconds. This range, shown by the arrow 93, is for a 25V110° color picture tube in FIG. 3. At about 10.9 seconds, the yield was highest at about 240 mgs. (milligrams). At about 14.3 seconds, the yield was lowest at about 160 mgs. Although there is some scattering of the results, a declining straight-line curve 95 can be drawn to generalize the results.

The time-to-start, shown by the arrow 97 in FIG. 2, has been used to determine yield. This was investigated, and it was concluded time-to-start correlated with yield, but not as well as time-to-peak, shown by the arrow 91 in FIG. 2. The relative height of the peak 85 was also investigated, and it was concluded that the different peaks did not correlate well according to their heights with respect to the characteristics of interest.

Figure 4:
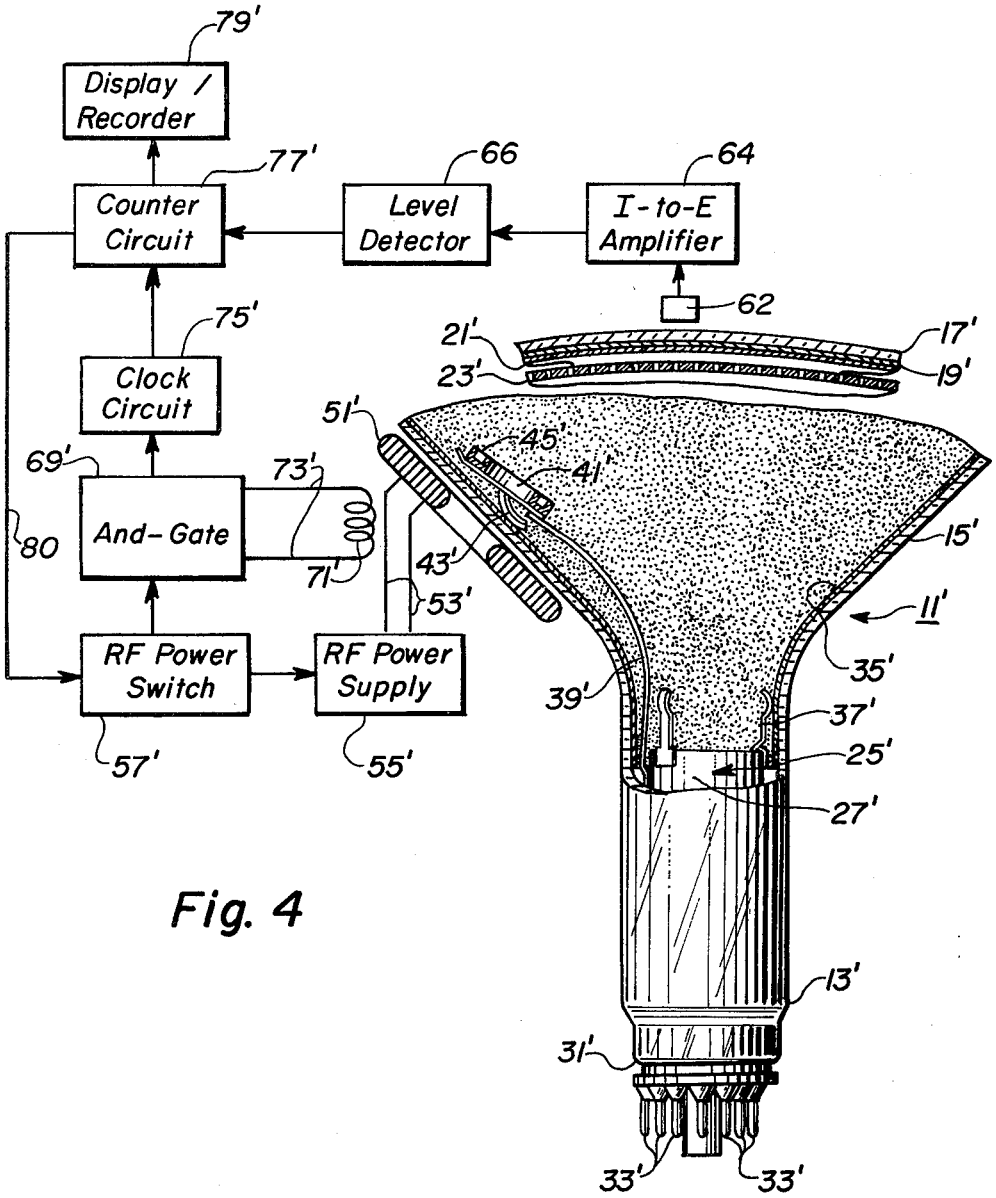
FIG. 4 is a fragmentary view, partially in cross section, of a CRT having the getter container in position for induction heating prior to vaporizing the getter material therein, and a block diagram circuit for detecting ionization by the novel method.

Still another characteristic of interest in the vaporization is whether ionization of the vaporized material has occurred during exothermic vaporization. Ionization is undesirable because it interferes with the amount and distribution of the vaporized getter material. Detection of ionization requires a second system, exemplified in FIG. 4, which is similar to the system shown in FIG. 1, and similar reference numerals are used for similar structures. The ionization-detection system shown in FIG. 4 employs a photodetector assembly 62 which detects light in about the 3,500 to 6,000 angstrom spectral range. This can be achieved, for example, with the combination of a blue-green optical filter, such as a CS-4-96 glass filter (Corning Glass Works) and a green-sensitive photodetector such as a PIN 10 diode silicon photodetector (United Detector Corp.)

The output signal of the photodetector 62 is photocurrent measured in nanoamperes, which is fed to an I-to-E amplifier 64 to convert the output signal to a sample voltage signal, which is then passed to a level detector 66 for detection of signal portions greater in amplitude than a prescribed arbitrary value. Such signal portions now pass to a counter circuit 77'. The counter circuit 77' correlates these signal portions with the output of the clock circuit 75' (as described with respect to FIG. 1) to produce a time-dependent sample voltage signal, which optionally may be displayed and/or recorded on a display/recorder 79. Also, these signal portions may be fed back through a feedback connection 80 to the RFpower switch 57' as described below.

Figure 5:
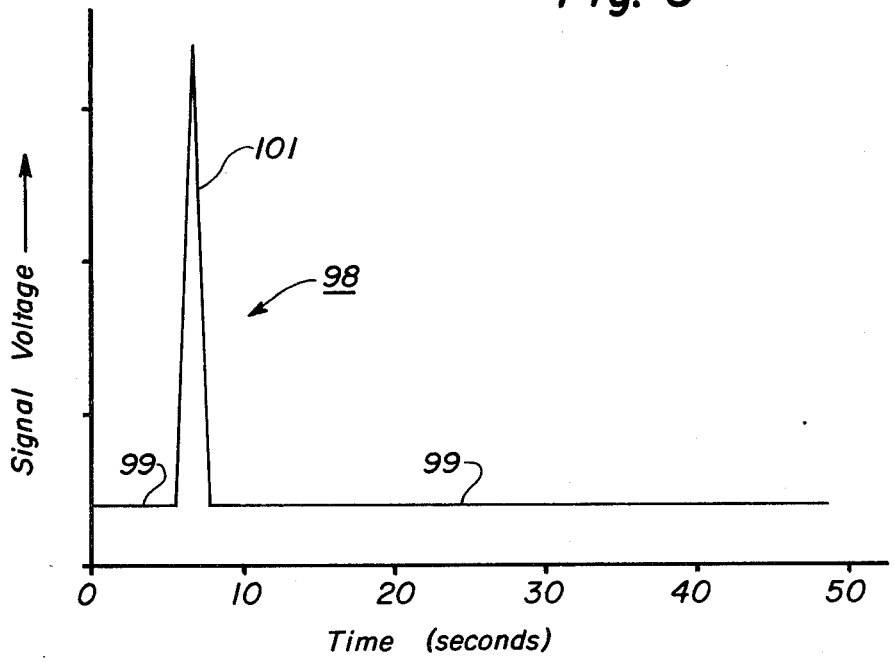
FIG. 5 is a diagram showing a typical time-dependent sample signal curve evidencing ionization during the practice of the novel method.

When ionization occurs, a sharply peaking pulse of about 0.1 to 10 seconds duration occurs soon after the start of the exothermic reaction; that is, soon after the first break 87 in the curve shown in FIG. 2. FIG. 5 shows a typical (but idealized) curve 98 displaying ionization that has occurred for a very short time during the vaporization. The curve 98 comprises a flat portion 99 which is caused by the ambient light. About 8 to 9 seconds after the start of RF energization of the RF coil, there is a short steeply-rising pulse 101. This ordinarily occurs on fewer than 1% of the tubes that are processed. A short pulse of less than one second's duration does not cause a problem. However, where the pulse lasts for much longer than one second, localized heating in the CRT may occur which may be destructive. By providing the feedback connection 80 between the counter 79 and the RF power switch 57, the count on a long pulse 101 can be used to turn off (de-energize) the coil 51 before damage to the CRT has occurred. The CRT can then be reprocessed.

The following observations have been made with respect to the novel method:

1. The best position for the photodetector is opposite the viewing window of the faceplate panel. The presence of the viewing screen and the shadow mask inside the CRT in the path of the light to be detected does not prevent reliable detection of light emanating from the vaporization. Positioning the photodetector on the funnel or neck of the CRT has been found to yield unreliable results.

2. The novel method can be used to determine the amount of getter material vaporized by exothermic reaction to within ±20 mgs.

3. The novel method can be used for processing any size or type of CRT. Also, since the photodetector is located opposite the viewing window of the panel, the novel method is independent of the internal structures in the CRT.

4. The getter container and the contents of the getter container may be any of the systems known in the art of gettering. For example, any of the systems described in the patents issued to Pappadis, Reash and Turnbull cited above may be used. It is preferred to use an alloy of constituents which react exothermically to yield a metallic getter material in vapor form. Barium metal vapor is preferred, although strontium or other metal vapor may be produced. Also, the alloy may yield, upon heating, controlled amounts of gas for the purpose of modifying the distribution and deposition of the vapor.

5. The novel method is described with respect to getter containers that are mounted to springs that are attached to the electron-gun mount assemblies. The getter container may, alternatively, be mounted near or on the inner surface of the envelope from any other structure; for example, from the anode button or from the frame on which the mask is mounted.

6. The novel method may be used as a testing or control procedure on automated machines, such, for example, as the automatic getter flashing machine described in U.S. patent application Ser. No. 134,216 filed Mar. 26, 1980 by D. E. Griesemer, Sr., now U.S. Pat. No. 4,335,926. The novel method can be applied from time to time to determine whether the mechanism is in proper adjustment, or, the method can be applied each time getter material is vaporized to determine for each particular tube whether vaporization has occurred, the character of the vaporization and whether the yield was adequate. 7. Only one of vaporization and ionization may be detected, or both characteristics may be detected at the same time.

What is claimed is:

1. In a method of vaporizing getter material from a getter container inside a vacuum electron tube, said method including heating said container and getter material until getter material vaporizes, the steps for determining at least one characteristic of interest of said vaporization including (a) sensing light emitted from said container and material from at least the onset of said heating, (b) producing a time-dependent sample signal from said sensed light, (c) comparing said sample signal with time-dependent criteria derived from vaporizations with known characteristics, and (d) deriving said characteristic of interest of said vaporization from said comparison.

2. The method defined in claim 1 wherein the sensed light is in the range of about 7,000 to 11,000 angstroms.

3. The method defined in claim 2 wherein an exothermic vaporization is derived when said sample signal exhibits a sharp peak after said onset of heating.

4. The method defined in claim 3 wherein the quantity of getter material vaporized is derived by comparing the time interval from said onset of heating to said peak with calibrated data.

5. The method defined in claim 2 wherein an endothermic vaporization is derived when said sample signal exhibits a slowly-rising rounded curve after said onset of heating.

6. The method defined in claim 1 wherein, at step (a), the sensed light is in the range of 3,500 to 6,000 angstroms.

7. The method defined in claim 6 wherein ionization of a substantial amount of said vaporized getter material is derived when said sample signal exhibits a sharp peak after said onset of heating.

8. In a method for vaporizing getter material from a getter container located inside the envelope of a cathode-ray tube, said method including heating said container and material to temperatures above about 800° C., whereby light is emitted from said container and material, the steps for determining at least one characteristic of interest of said vaporization including (a) sensing light emitted from said container and material through said envelope starting at least at the onset of said heating, said light being in a selected spectral range, (b) producing a time-dependent sample signal from said sensed light, (c) comparing said sample signal with criteria definitive of characteristics of interest to said vaporization, (d) and, in view of step (c), determining at least one of (i) whether vaporization has taken place (ii) if vaporization has taken place, whether vaporization is predominantly exothermic or endothermic, (iii) and, if vaporization has taken place, whether said vaporization has evolved more than a prescribed quantity of getter material, (iv) and if vaporization has taken place, whether a substantial amount of said getter material has ionized.

9. The method defined in claim 8 wherein said sample signal exhibits definitive characteristics within about 5 to 40 seconds after said onset of heating.

10. The method defined in claim 8 wherein said light is sensed by an electronic sensor located outside said envelope opposite the window of said cathode-ray tube.

* * * * *